US007762711B2

(12) United States Patent
Tseng

(10) Patent No.: US 7,762,711 B2
(45) Date of Patent: Jul. 27, 2010

(54) LAMP

(75) Inventor: Wei Jen Tseng, 5F, No. 10, Lane 23, Tungshan Street, Hsinchu City (TW)

(73) Assignee: Wei Jen Tseng, Hsinchu (TW)

( * ) Notice: Subject to any disclaimer, the term of this patent is extended or adjusted under 35 U.S.C. 154(b) by 149 days.

(21) Appl. No.: 12/254,642

(22) Filed: Oct. 20, 2008

(65) Prior Publication Data

US 2010/0097790 A1 Apr. 22, 2010

(51) Int. Cl.
*H01R 33/00* (2006.01)

(52) U.S. Cl. ..... 362/654; 362/311.02; 362/800; 362/806

(58) Field of Classification Search ..... 362/249.02, 362/311.02, 652–656, 800, 806
See application file for complete search history.

*Primary Examiner*—Jason Moon Han

(57) ABSTRACT

A lamp has a socket and a holder having a plug and a lens. The plug has a top surface, a light emitting diode (LED) mount and an LED. The LED mount is formed centrally on the top surface of the plug. The LED is mounted in the LED mount of the holder. The lens is mounted around the LED mount and has at least one auxiliary lens and a holding lens. Each auxiliary lens has an annulus and multiple decorative protrusions. The holding lens is mounted through the annulus of the auxiliary lens. Therefore, the holding lens and at least one auxiliary lens are manufactured individually to reduce manufacturing costs and complexity and attain easily adaptable designs.

18 Claims, 9 Drawing Sheets

LAMP

BACKGROUND OF THE INVENTION

1. Field of the Invention

The present invention relates to lamps, especially to a lamp for a light string having an ornamental lens.

2. Description of the Prior Arts

Light strings are used for decoration during celebrations, festivals and for aesthetic purposes and comprise multiple lamps. Each lamp comprises a light and a lens. The light may be a light emitting diode (LED) having a high brightness to power ratio so is cheaper and safer to operate.

Generally the lens is monotonous and not interesting to consumers. However, a lens with complex structure is difficult to remove for maintenance and difficult to produce causing the LED lamp having a lens with complex structure to be more expensive.

To overcome the shortcomings, the present invention provides a lamp to mitigate or obviate the aforementioned problems.

SUMMARY OF THE INVENTION

The main objective of the present invention is to provide a lamp for a light string having an ornamental lens.

A lamp in accordance with the present invention has a holder having a plug and a lens. The plug has a top surface, a light emitting diode (LED) mount and an LED. The LED mount is formed centrally on the top surface of the plug. The LED is mounted in the LED mount of the holder. The lens is mounted around the LED mount and has at least one auxiliary lens and a holding lens. Each auxiliary lens has an annulus and multiple decorative protrusions. The holding lens is mounted through the annulus of the auxiliary lens. Therefore, the holding lens and at least one auxiliary lens are manufactured individually to reduce manufacturing costs and complexity and attain easily adaptable designs.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
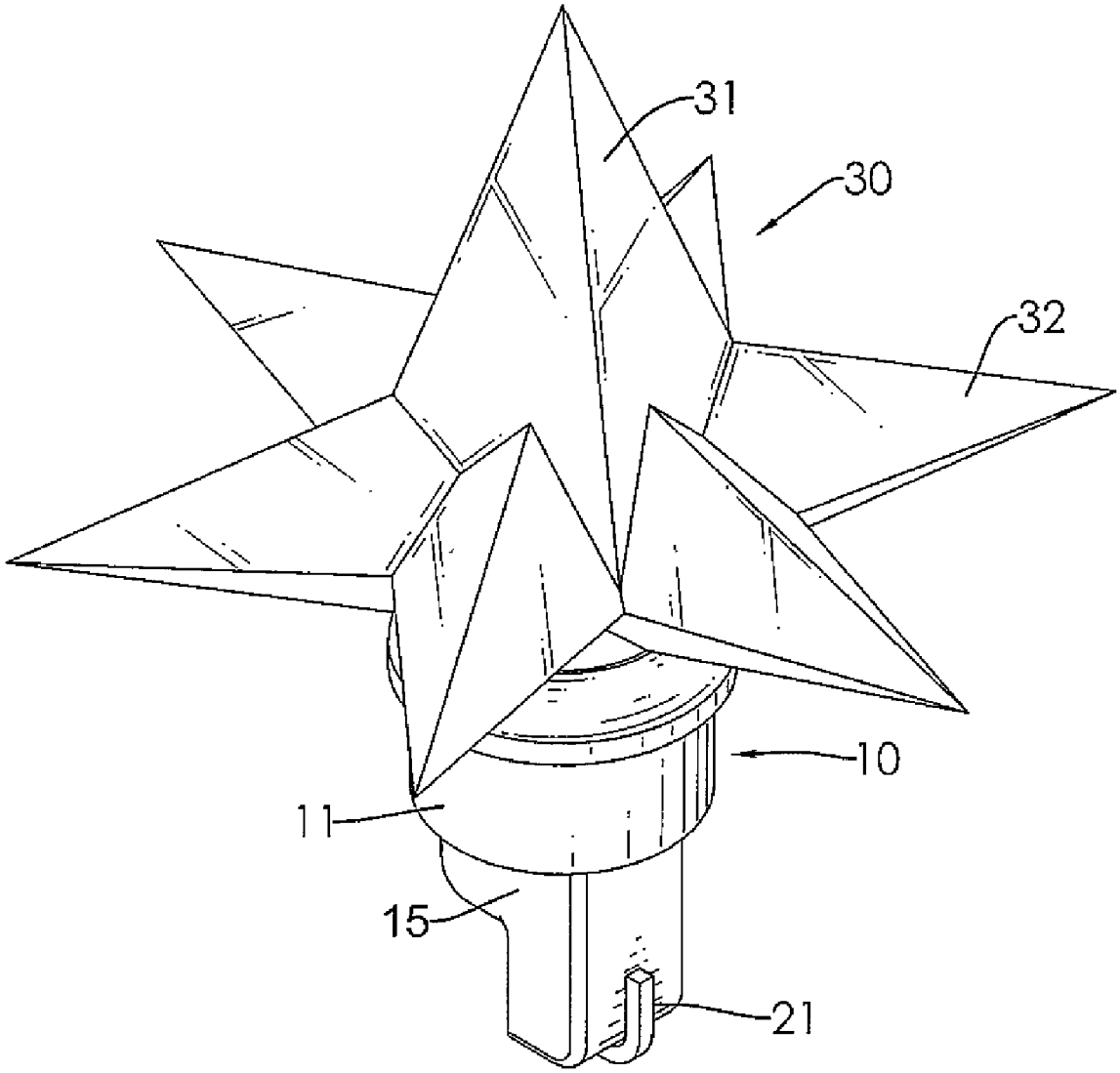
FIG. 1 is a perspective view of a first embodiment of a lamp in accordance with the present invention.
Figure 2:
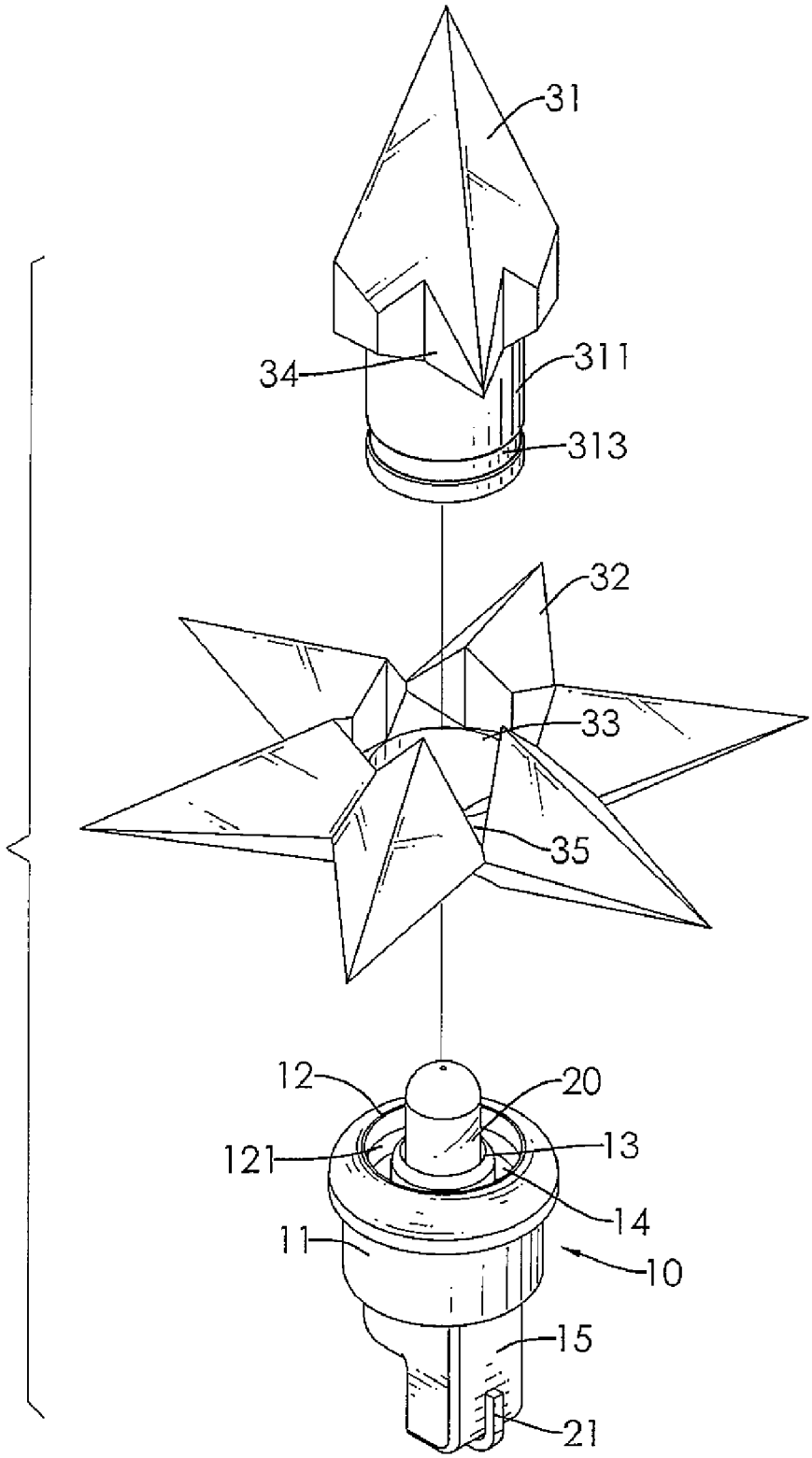
FIG. 2 is an exploded perspective view of the lamp in FIG. 1.
Figure 3:
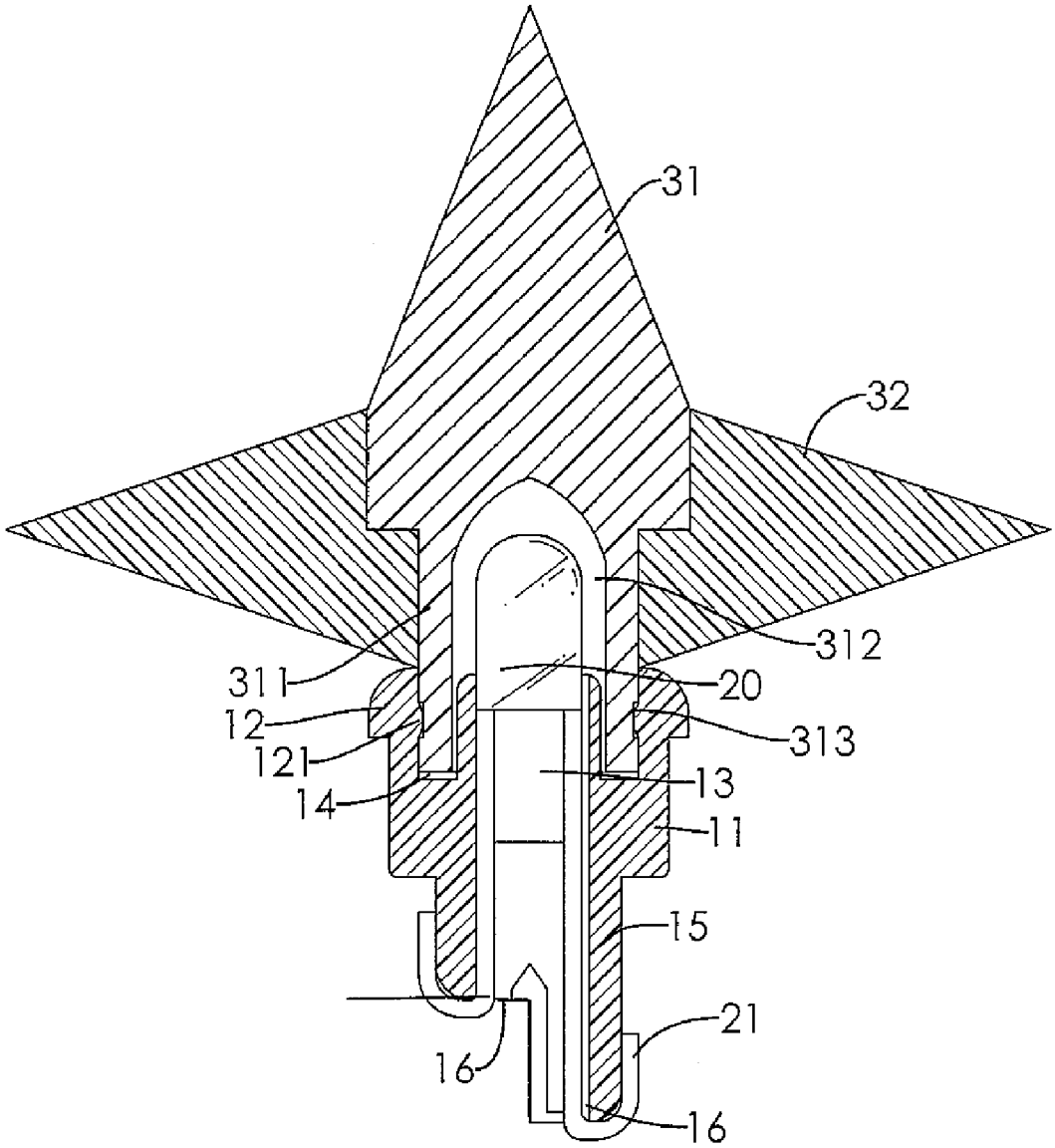
FIG. 3 is a side view in partial section of the lamp in FIG. 1.

With reference to FIGS. 1 to 3, a lamp in accordance with the present invention comprises a holder (10), a light emitting diode (LED) (20) and a lens (30).

Figure 9:
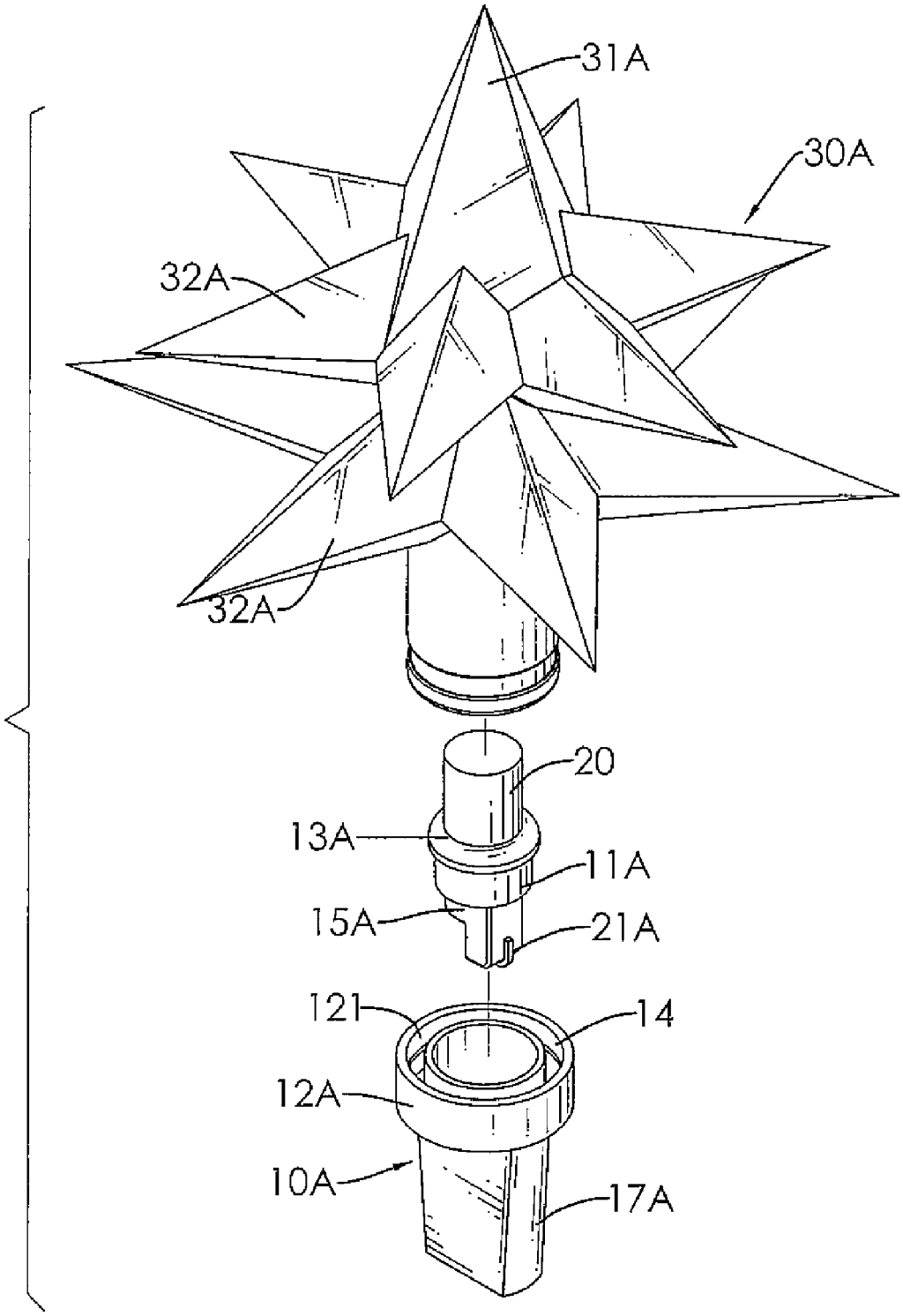
FIG. 9 is an exploded perspective view of a fifth embodiment of a lamp in accordance with the present invention.

With further reference to FIG. 9, the holder (10) has a socket (17A), a plug (11, 11A) and an annular sleeve (12, 12A).

In a fifth embodiment of the lamp, the socket (17A) is connected to an external power source, may be through a light string and has a mounting chamber, two terminals and a rim. The mounting chamber is formed in the socket (17A) and may be polygonal. The terminals are mounted in the mounting chamber of the socket (17A).

The plug (11, 11A) has a bottom, a top surface, an LED mount (13, 13A) and a connector (15, 15A). The LED mount (13, 13A) is formed centrally on the top surface of the plug (11, 11A), may protrude from the top surface of the plug (11, 11A) and has a through hole formed through the plug (11, 11A).

The connector (15, 15A) is formed on and protrudes from the bottom of the plug (11, 11A), corresponds to the mounting chamber of the socket (17A) and has a bottom, an outer surface and two leg holes (16). The leg holes (16) are formed separately through the bottom of the connector (15) and communicate with the through hole of the LED mount (13, 13A).

The annular sleeve (12, 12A) is mounted around the LED mount (13, 13A) and has an inner surface and a detent (121). The annular sleeve (12, 12A) may be formed on the plug (11) or may be formed on the rim of the socket (17A). The detent (121) is formed on the inner surface of the annular sleeve (12, 12A).

The LED (20, 20A) is mounted in the LED mount (13, 13A) of the holder (10, 10A) and has a bottom and two legs (21, 21A). The legs (21) are electrically conductive, are mounted respectively through the leg holes (16) of the connector (15) and are formed around the outer surface of the connector (15) to hold the LED (20) in place and connect the LED (20) to an external power source, through the terminals of the socket (17A). Each leg (21) may have U-shaped distal section hooking on the bottom of the connector (15) for electrically contacting purposes.

The lens (30) is mounted in the annular sleeve (12) and has at least one auxiliary lens (32) and a holding lens (31).

Figure 8:
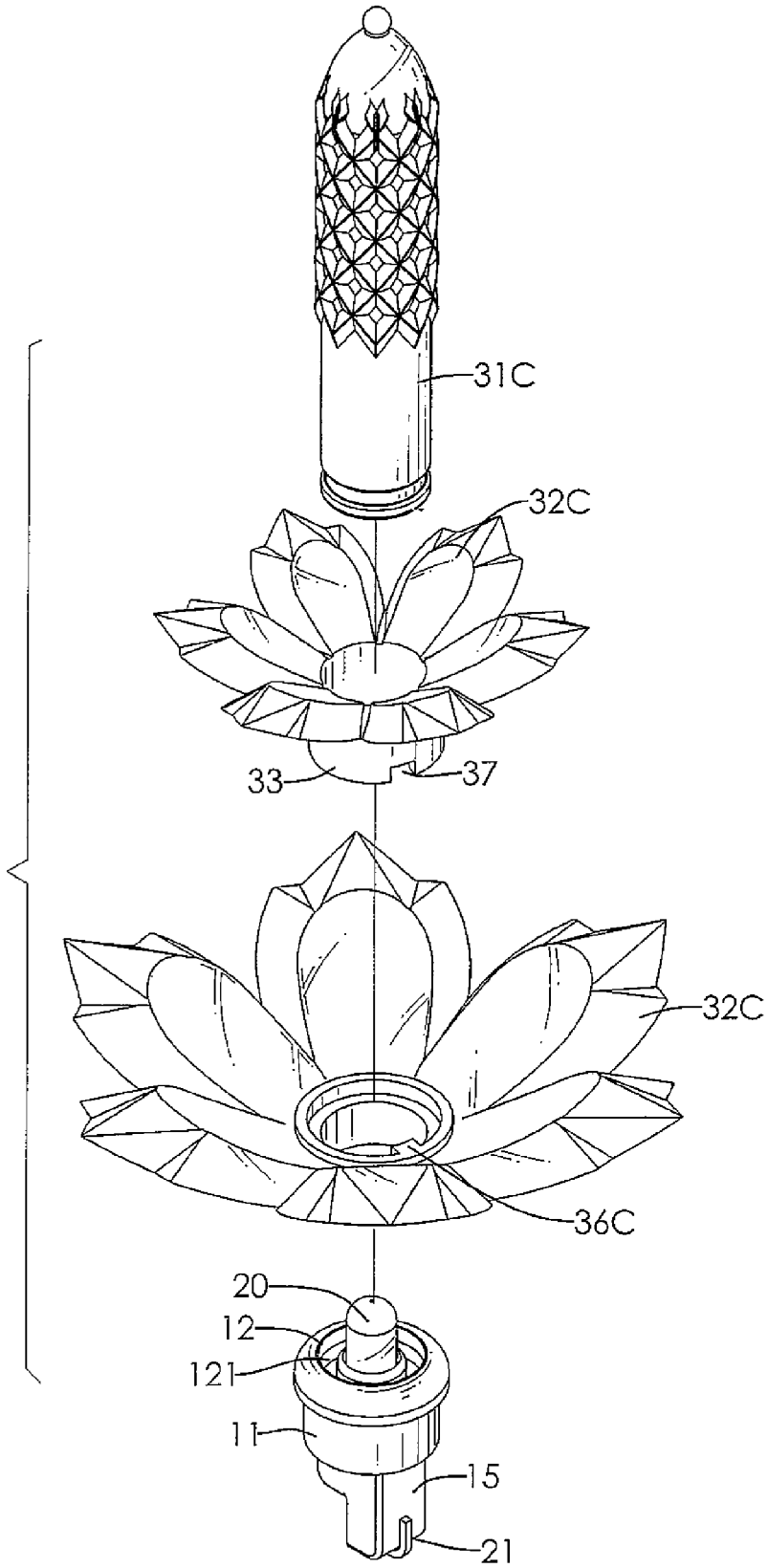
FIG. 8 is an exploded perspective view of the lamp in FIG. 7.

With further reference to FIG. 8, each of the at least one auxiliary lens (32) has an annulus (33), multiple decorative protrusions and may comprise at least one recess (35). The annulus (33) has an inner surface and an outer surface. The decorative protrusions may be star spurs, flower petals or the like and protrude radially from the annulus (33). The at least one recess (35) is formed in the annulus (33) and may be formed through the annulus (33).

The holding lens (31) is mounted through the annulus (33) of the auxiliary lens (32) and has an inner end, an outer end, a mounting tube (311), an LED chamber (312), a detent (313), at least one projection (34) and decoration. The mounting tube (311) is formed on and protrudes from the inner end of the holding lens (31), corresponds to and is mounted in the annular sleeve (12, 12A) of the holder (10, 10A) and has an outer surface and a bottom. The LED chamber (312) is formed in the mounting tube (311) and is mounted around the LED (20, 20A). The detent (313) is formed on the outer surface of the mounting tube (311) adjacent to the bottom of the mounting tube (311) and corresponds to the detent (121) of the annular sleeve (12, 12A). The detents (313, 121) of the mounting tube (311) and the annular sleeve (12, 12A) may be implemented as a boss and recess, boss and annular groove, annular projection and annular groove or the like. The at least one projection (34) is formed on and protrudes from the holding lens (31) and corresponds respectively to the at least one recess (35) of the at least one auxiliary lens (32) to prevent the holding lens (31) from moving or rotating relative to the at least one auxiliary lens (32). The decoration of the holding lens (31) may be flower petals, flower pistal, a patterned diffraction pattern, a star spur or the like.

In a first embodiment of the lamp, the lens (30) may be implemented as one holding lens (31) and one auxiliary lens (32), as shown in FIGS. 1 to 3. The decoration and at least one projection (34) of the holding lens (31) are star spurs and the decorative protrusions of the auxiliary lens (32) are star spurs. Preferably, six star spurs are implemented on the auxiliary lens (32), and the detents (313) of the mounting tube (311) and the annular sleeve (12) are respectively implemented as an annular groove and an annular projection.

Figure 4:
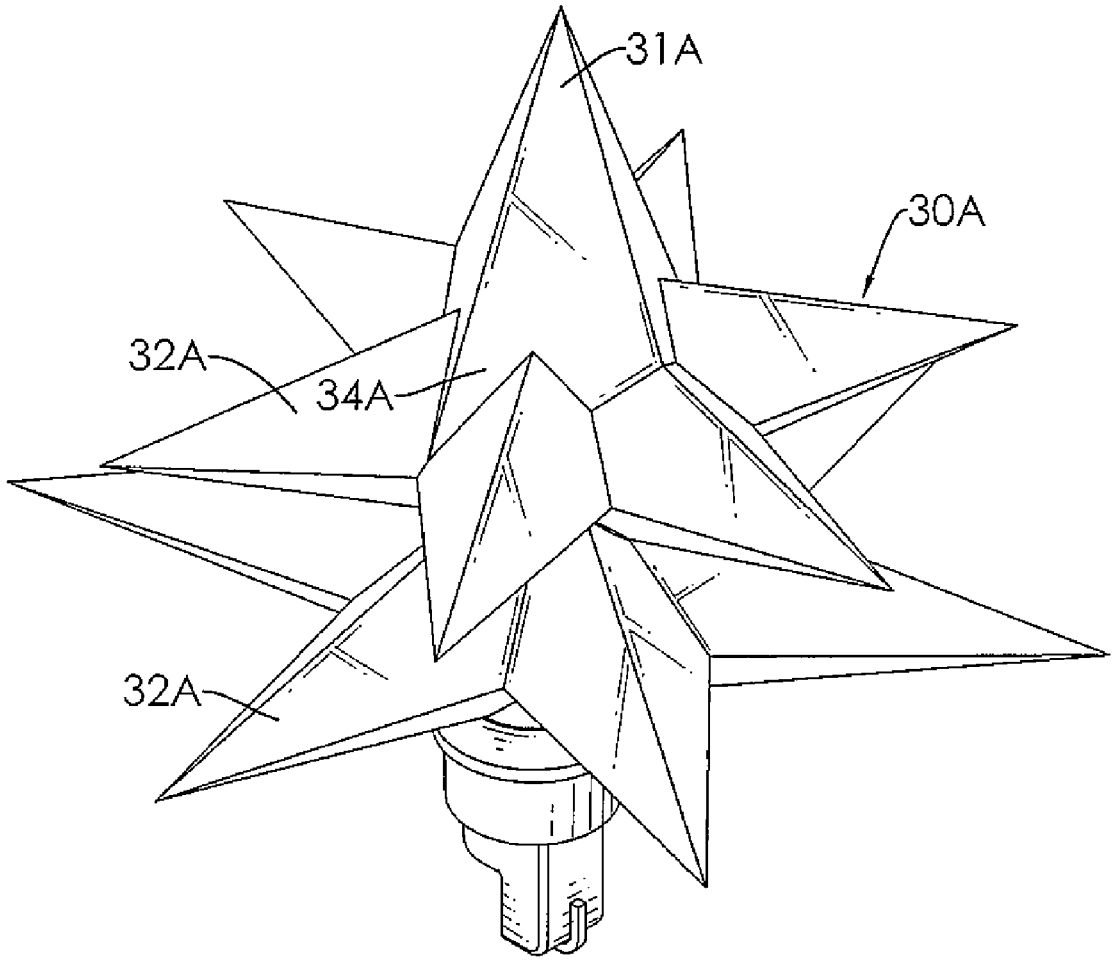
FIG. 4 is a perspective view of a second embodiment of a lamp in accordance with the present invention.

With further reference to FIG. 4, in a second embodiment of the lamp, the lens (30A) may be implemented as one holding lens (31A) and two auxiliary lenses (32A), wherein the decoration and at least one projection (34A) of the holding lens (31A) are star spurs and the decorative protrusions of the auxiliary lens (32A) are star spurs, preferably, six star spurs are implemented on each of the auxiliary lenses (32A).

Figure 5:
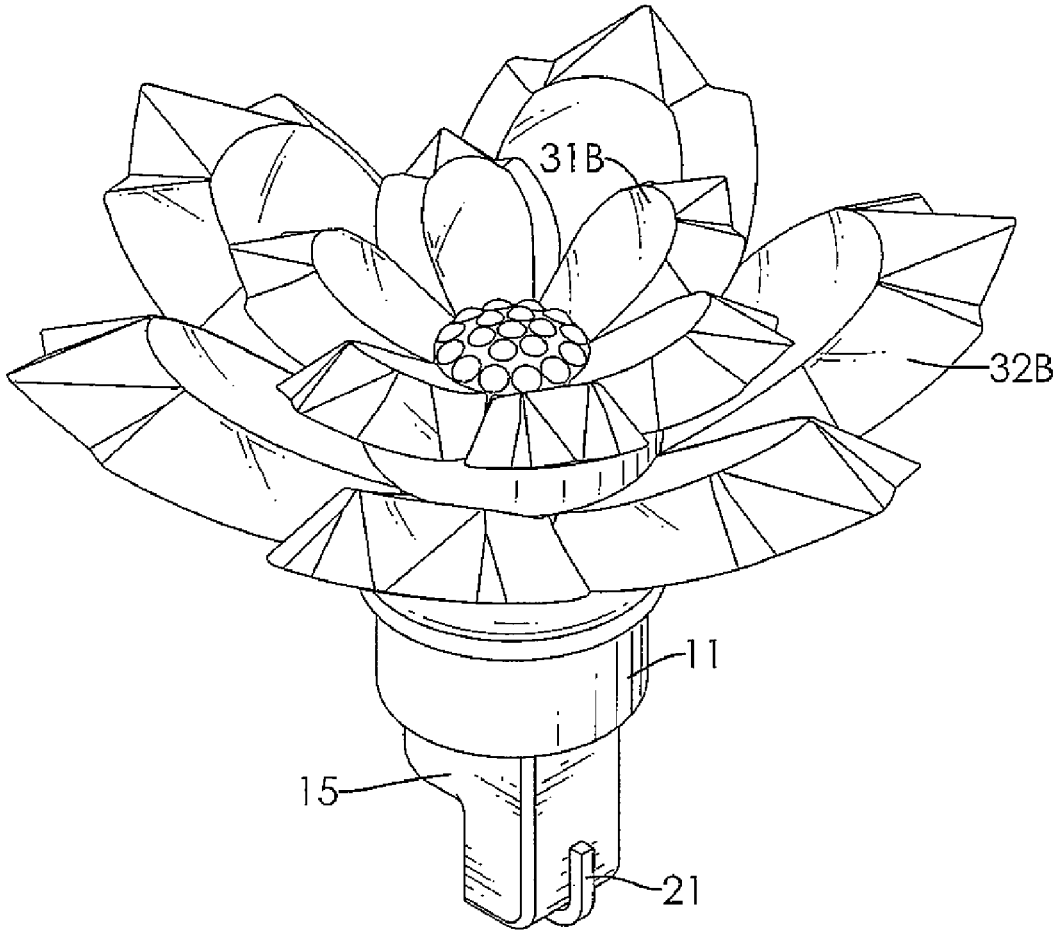
FIG. 5 is a perspective view of a third embodiment of a lamp in accordance with the present invention.
Figure 6:
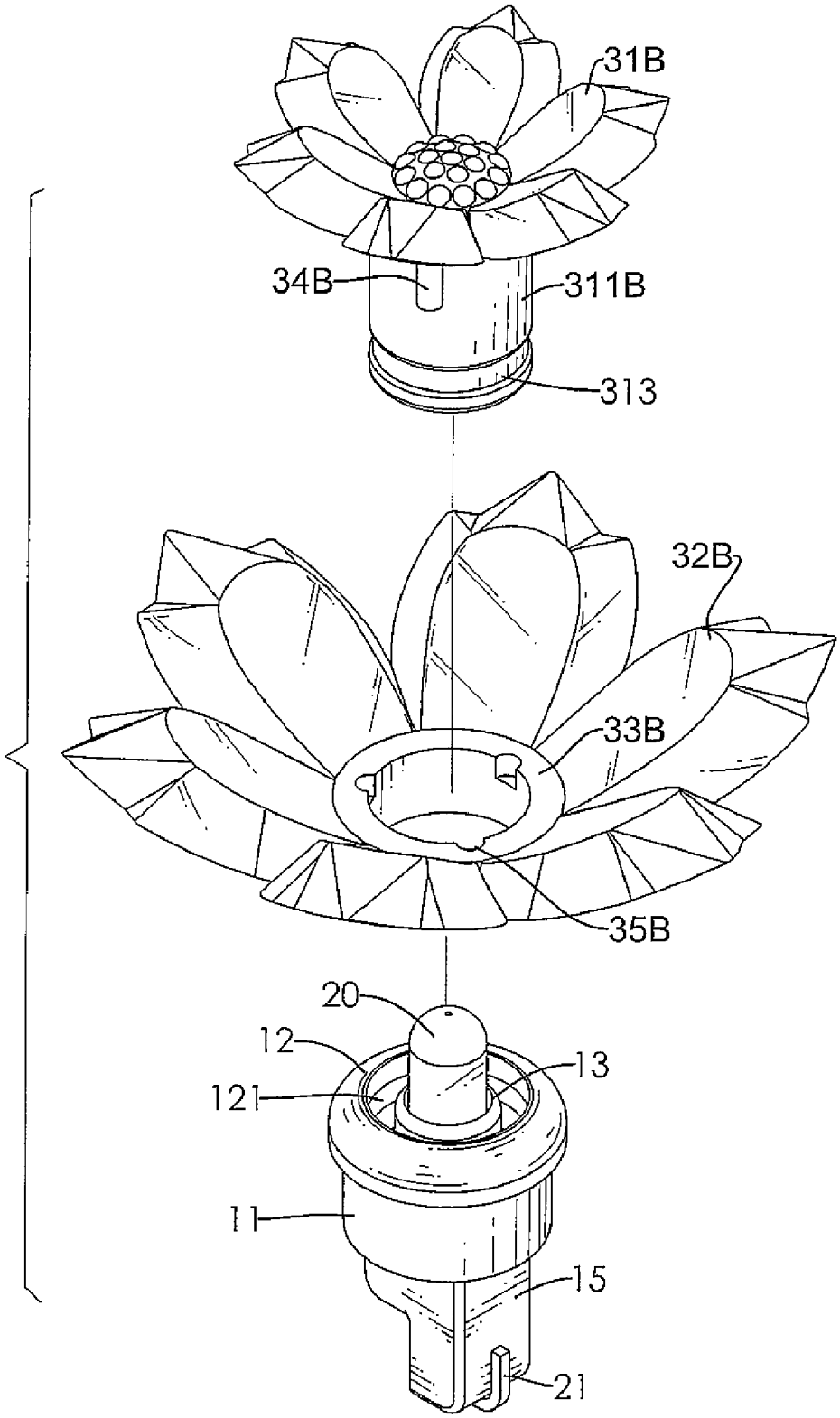
FIG. 6 is an exploded perspective view of the lamp in FIG. 5.

With further reference to FIGS. 5 and 6, in a third embodiment of the lamp, the lens (30B) may be implemented as one holding lens (31B) and one auxiliary lens (32B), wherein the decoration on holding lens (31B) is a flower pistal and petals, the at least one projection (34B) of the holding lens (31B) is a boss (34B) and the decorative protrusions of the auxiliary lens (32B) are petals, preferably, six petals are implemented on each of the lenses (31B, 32B) and the at least one recess (35B) is formed on the inner surface of the annulus (33B) and corresponds to the at least one boss (34B).

Figure 7:
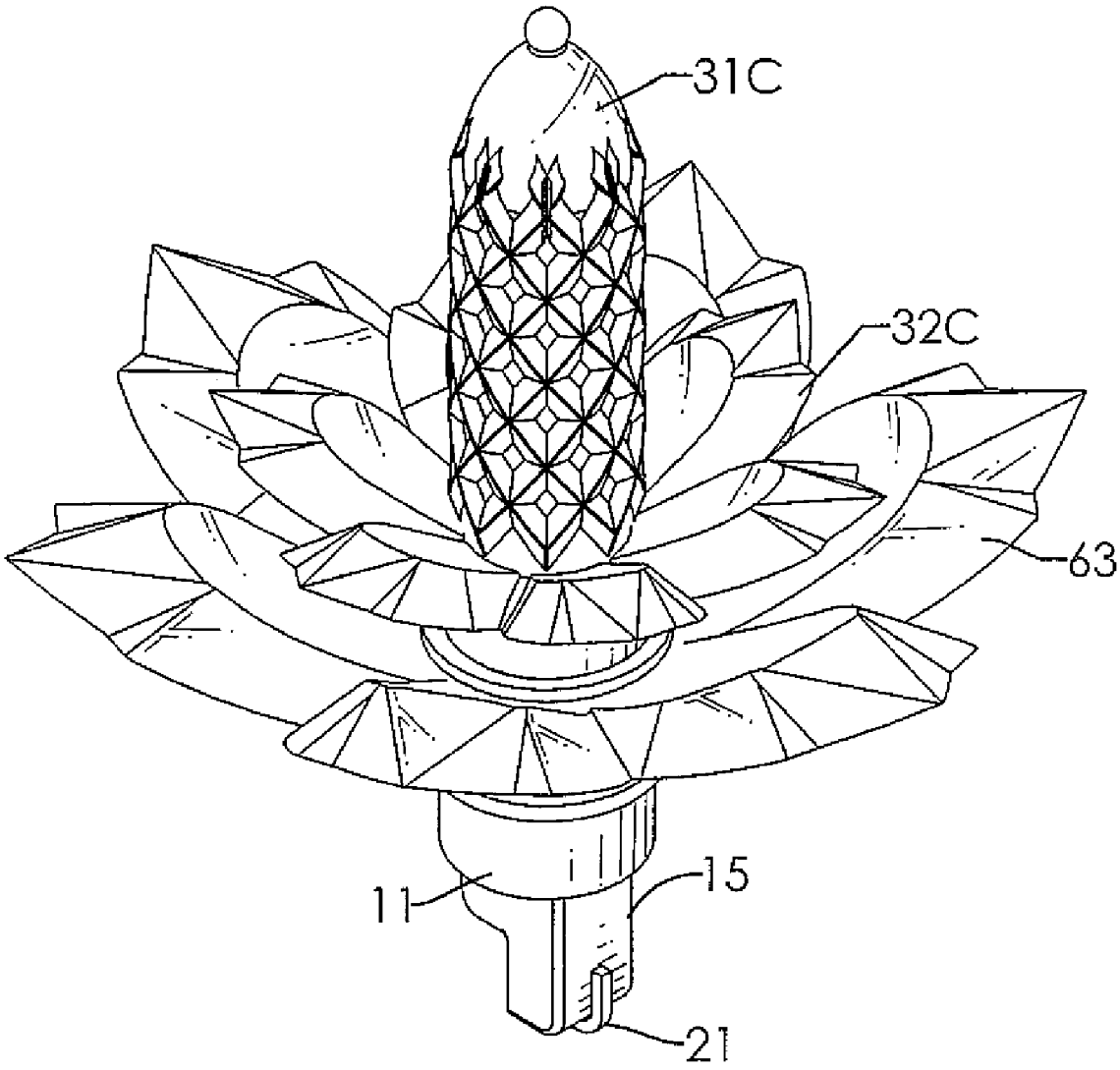
FIG. 7 is a perspective view of a fourth embodiment of a lamp in accordance with the present invention.

With further reference to FIGS. 7 and 8, in a fourth embodiment of the lamp, the lens (30C) may be implemented as one holding lens (31C) and multiple auxiliary lenses (32C). The decoration on the holding lens (31C) is a diffraction pattern and pistal and the decorative protrusions of the auxiliary lenses (32C) are petals. Preferably, six petals are implemented on each of the auxiliary lenses (32C). One of adjacent auxiliary lenses (32C) has at least one notch (37) and the other has at least one boss (36C). The at least one notch (37) is defined in annulus (33) of the auxiliary lens (32C). The at least one boss (36C) is formed on the inner surface of the annulus (33) and is engaged respectively with the at least one notch (37).

The lens (30) is composed of the holding lens (31) and at least one auxiliary lens (32). However, the holding lens (31) and at least one auxiliary lens (32) are manufacture individually to reduce manufacturing costs and complexity and attain easily adaptable designs. Furthermore, faulty or broken lamps may be repaired or replaced before or after sale to reduce rejection rate and improve product longevity.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A lamp comprising
- a holder having
  - a plug having
    - a bottom;
    - a top surface;
    - a light emitting diode (LED) mount being formed centrally on the top surface of the plug and having a through hole formed through the plug; and
    - a connector being formed on and protruding from the bottom of the plug and corresponding to a mounting chamber; and
  - an annular sleeve being mounted around the LED mount and having
    - an inner surface; and
    - a detent being formed on the inner surface of the annular sleeve;
- an LED being mounted in the LED mount of the holder and having two legs to connect the LED to an external power source through terminals of a socket; and
- a lens being mounted in the annular sleeve and having
  - at least one auxiliary lens and each one of the at least one auxiliary lens having
    - an annulus having an inner and outer surface; and
    - multiple decorative protrusions; and
  - a holding lens being mounted through the annulus of the at least one auxiliary lens and having
    - an inner end;
    - an outer end;
    - a mounting tube being formed on and protruding from a bottom of the inner end of the holding lens, corresponding to and being mounted in the annular sleeve of the holder and having
      - an outer surface; and
      - a bottom;
    - an LED chamber being formed in the mounting tube and being mounted around the LED; and
    - a detent being formed on the outer surface of the mounting tube adjacent to the bottom of the mounting tube and corresponding to the detent of the annular sleeve; and
    - a decoration.

2. The lamp as claimed in claim 1, wherein
- the lamp further has a socket being adapted to be connected to the external power source and having
  - a mounting chamber being formed in the socket;
  - two terminals being mounted in the mounting chamber; and
  - a rim;
- the annular sleeve is formed on the socket.

3. The lamp as claimed in claim 1, wherein the annular sleeve is formed on the plug.

4. The lamp as claimed in claim 3, wherein the connector further has
- a bottom;
- an outer surface; and
- two leg holes being formed separately through the bottom of the connector and communicating with the through hole of the LED mount; and
- the two legs of the LED are mounted respectively through the leg holes of the connector and are formed around the outer surface of the connector.

5. The lamp as claimed in claim 4, wherein the mounting tube has a detent.

6. The lamp as claimed in claim 5, wherein each one of the at least one auxiliary lens further has
- at least one recess being formed in the annulus; and the mounting tube further has at least one projection being formed on and protruding from the holding lens and corresponding respectively to the at least one recess of the auxiliary lens.

7. The lamp as claimed in claim 6, wherein the lamp has multiple auxiliary lenses;

one of adjacent auxiliary lenses has at least one notch defined in annulus of the auxiliary lens; and the other of the adjacent auxiliary lenses has at least one boss formed on the inner surface of the annulus of the auxiliary lens and engaged respectively with the at least one notch.

8. The lamp as claimed in claim 1, wherein the decorative protrusions are flower petals and the decoration of the holding lens is flower pistal.

9. The lamp as claimed in claim 2, wherein the decorative protrusions are flower petals and the decoration of the holding lens is flower pistal.

10. The lamp as claimed in claim 3, wherein the decorative protrusions are flower petals and the decoration of the holding lens is flower pistal.

11. The lamp as claimed in claim 4, wherein the decorative protrusions are flower petals and the decoration of the holding lens is flower pistal.

12. The lamp as claimed in claim 5, wherein the decorative protrusions are flower petals and the decoration of the holding lens is flower pistal.

13. The lamp as claimed in claim 6, wherein the decorative protrusions are flower petals and the decoration of the holding lens is flower pistal.

14. The lamp as claimed in claim 7, wherein the decorative protrusions are flower petals and the decoration of the holding lens is flower pistal.

15. The lamp as claimed in claim 1, wherein the decorative protrusions are star spurs and the decoration of the holding lens is a star spur.

16. The lamp as claimed in claim 2, wherein the decorative protrusions are star spurs and the decoration of the holding lens is a star spur.

17. The lamp as claimed in claim 3, wherein the decorative protrusions are star spurs and the decoration of the holding lens is a star spur.

18. The lamp as claimed in claim 4, wherein the decorative protrusions are star spurs and the decoration of the holding lens is a star spur.

* * * * *